US006543951B1

(12) United States Patent
Bauman

(10) Patent No.: US 6,543,951 B1
(45) Date of Patent: Apr. 8, 2003

(54) HAND-SUPPORTED WINDSHIELD CLEANER

(76) Inventor: Robert C. Bauman, 232 Goodhouse Rd., Litchfield, CT (US) 06759

( * ) Notice: Subject to any disclaimer, the term of this patent is extended or adjusted under 35 U.S.C. 154(b) by 0 days.

(21) Appl. No.: 09/592,519

(22) Filed: Jun. 12, 2000

(51) Int. Cl.[7] ..... A46B 5/02; B05C 11/00

(52) U.S. Cl. ..... 401/8; 401/6; 401/266; 401/265; 401/183; 401/118; 401/119; 15/220.1; 15/232

(58) Field of Search ..... 401/7, 6, 8, 266, 401/265, 263, 184, 185, 118, 119, 123, 183; 15/220.1, 231, 232

(56) References Cited

U.S. PATENT DOCUMENTS

| | | | | | |
|---|---|---|---|---|---|
| 763,888 | A | * | 6/1904 | Hayden | 15/232 |
| 765,314 | A | * | 7/1904 | Hayden | 15/232 |
| 1,334,911 | A | * | 3/1920 | Lampkin | 401/266 |
| 1,344,890 | A | * | 6/1920 | Henry | 15/232 |
| 1,783,788 | A | | 12/1930 | Hatchett, Sr. | |
| 2,746,461 | A | * | 5/1956 | Bocchino | 401/185 |
| 3,280,420 | A | * | 10/1966 | Wanzenberg | 401/7 |
| 4,071,983 | A | * | 2/1978 | Thielen | 15/232 |
| 5,248,211 | A | | 9/1993 | Holst | |
| 5,328,283 | A | * | 7/1994 | Viens | 401/8 |
| 5,397,194 | A | * | 3/1995 | Yuan et al. | 401/266 |
| 5,596,787 | A | | 1/1997 | Stevens et al. | |
| 5,671,497 | A | * | 9/1997 | Abdo | 401/6 |
| 6,036,391 | A | * | 3/2000 | Holliday et al. | 401/184 |

* cited by examiner

*Primary Examiner*—David J. Walczak

(57) ABSTRACT

A hand-supported wiper for cleaning automobile windshields comprising a carrier member, a finger grip on one surface of the support member and a cleaning pad on the other surface of the support member which is fabricated of an absorbent fibrous material and has an adhesive on one surface releasably adhering the pad to the carrier member. The carrier member provides a shallow recess in which the cleaning pad is disposed with marginal portions of the pad extending at least to the peripheral edge of the carrier member. The grip has a passage in which the user's fingers extend and which is generally parallel to the carrier member, and has arcuate recesses in which the user's fingers seat.

19 Claims, 3 Drawing Sheets

HAND-SUPPORTED WINDSHIELD CLEANER

BACKGROUND OF THE INVENTION

The present invention relates to windshield cleaners, and, more particularly, a hand-supported cleaner for the interior surface of windshields.

Synthetic resins are now extensively used in the interior of the modem automobile and some plastics may out-gas volatile materials such as plasticizers and solvents. As a result, the inside of the windshield become coated with a film that can seriously impair visibility. Cigarette smoke can also result in a deposit on the inside of the windshield to affect visibility.

Traditional methods of cleaning the inside of the windshield have used paper towels and rags held in the palm of the hand and pressed against the surface to be cleaned. Because of the awkward upward slant of the of the windshield relative to the extended human palm, it is frequently quite difficult to clean the surface in a comprehensive manner. Areas are missed, and resultant streaks are commonly observed. Moreover, it is difficult to manipulate the paper towel or rag in the narrow space at the juncture of the windshield and dashboard.

It is an object of the present invention to provide a novel hand-supported cleaner for cleaning an automobile windshield which is simple to fabricate and easy to manipulate even in difficult areas.

It is also an object to provide such a hand-supported cleaner which is economical and supported by the user's hand in a fashion which enables its movement easily into various areas of the windshield to effect the cleaning action.

Another object is to provide such a hand-supported cleaner which includes a cleaning fluid for the cleaning pad supported thereof.

SUMMARY OF THE INVENTION

It has now been found that the foregoing and related objects may be readily attained in a hand-supported wiper for cleaning automobile windshields comprising a carrier member, a finger grip on one surface of the support member and a cleaning pad on the other surface of the support member.

Preferably, the other surface of the carrier member provides a shallow recess in which the body portion of the cleaning pad is disposed with marginal portions of the pad extending at least to, and desirably over, the peripheral edge of the carrier member. The portion of the recess adjacent the periphery slopes gradually outwardly and upwardly to the edge.

Desirably, the pad has slits extending inwardly adjacent the comers thereof to facilitate forming of the pad about the peripheral edge of the carrier member. The pad is fabricated of a absorbent fibrous material and has an adhesive on one surface releasably adhering the pad to the carrier member.

Generally, the finger grip extends in a plane which is generally perpendicular to the plane of the carrier member, and has a passage through which the user's fingers extend. This passageway extends generally parallel to the carrier member and at least one of the opposing walls defining one side of the passageway has opposed arcuate recesses in which the user's fingers seat. Desirably, the grip has arcuate recesses on at least one of its side surfaces in which the user's fingers also seat.

In one embodiment, the carrier member is porous and the wiper includes a reservoir on the one surface of the carrier member for cleaning fluid which is in contact with the support member to transfer fluid therethrough to the cleaning pad. Conveniently, the finger grip has a cavity therein providing the reservoir.

In another embodiment, the carrier member has mounting means on the one surface spaced from the grip and a container for cleaning fluid is disengageably seated in the mounting means.

The carrier member is generally rectangular, and, to facilitate cleaning of the juncture between the windshield and dashboard, the grip is spaced inwardly from the periphery of the carrier member a distance dimensioned to enable at least one of the peripheral portions of the carrier member and cleaning pad to extend thereinto.

In a desirable embodiment, the carrier member is foldable in the direction of the other surface to facilitate storage. This is conveniently provided by fabricating the carrier member from synthetic resin to include an integral hinge about which it will fold.

DETAILED DESCRIPTION OF THE ILLUSTRATED EMBODIMENTS

Figure 1:
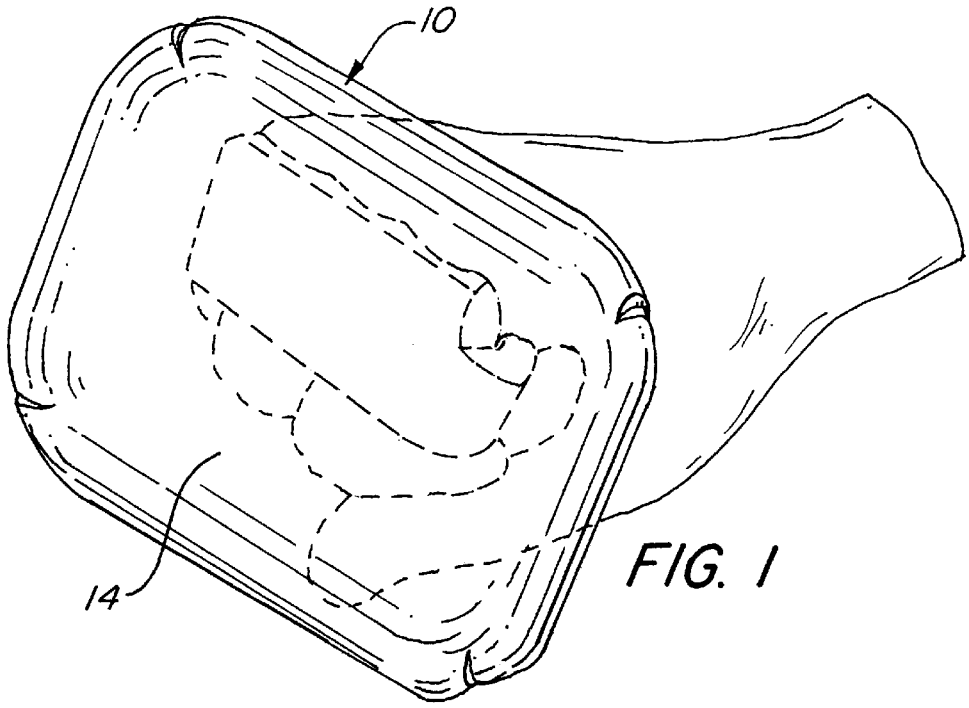
FIG. 1 is a perspective view of a hand-supported windshield cleaner embodying the present invention as gripped in the fragmentarily illustrated hand of a user.
Figure 2:
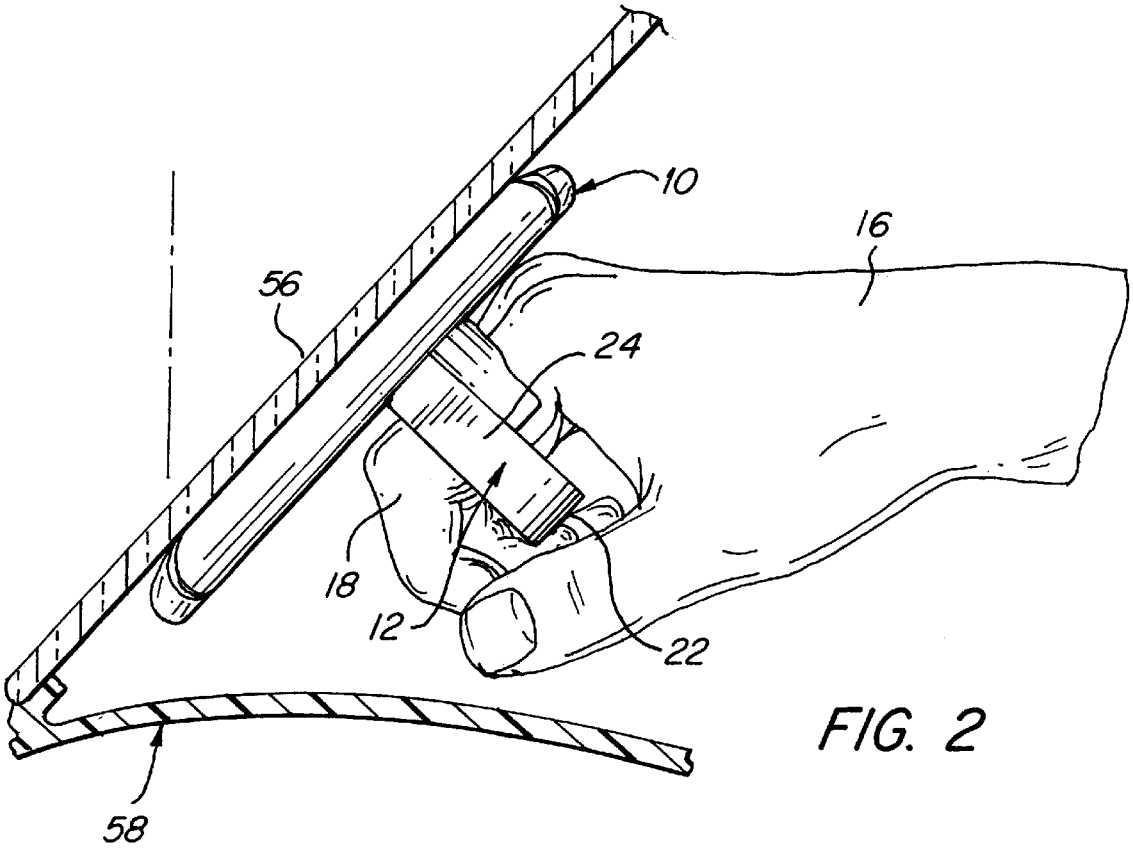
FIG. 2 is a side elevational view of the cleaner and user's hand with the cleaner being moved into the juncture between the windshield and dashboard.

Turning first to FIGS. 1–5 of the attached drawings, therein illustrated is a first embodiment of a hand-supported windshield cleaner embodying the present invention which is comprised of the carrier member designated by the numeral 10 which has a grip generally designated by the numeral 12 on one surface thereof, and supports a cleaning pad generally designated by the numeral 14 on the other surface thereof. As can be seen in FIGS. 1 and 2, the fingers 18 of the user's hand 16 extend through the grip 12 so that it may be easily manipulated for movement against the surface of the windshield 56 and even into the narrow space at the juncture between the windshield 56 and the dashboard 58 as seen in FIG. 2.

Figure 3:
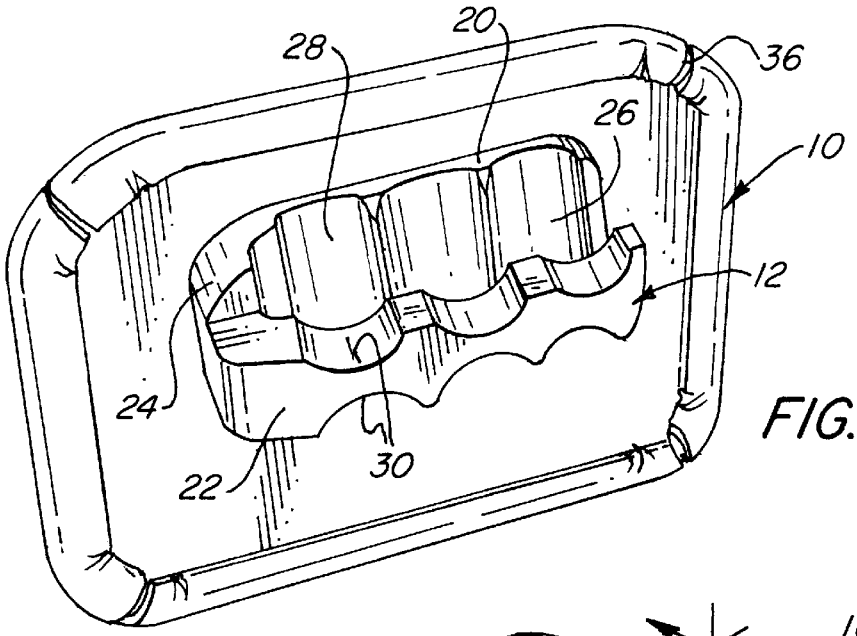
FIG. 3 is a rear perspective view of the windshield cleaner.

Turning first in detail to the grip 12 as best seen in FIG. 3, it has an upper portion 20 and a lower portion 22 with a web 24 extending between one end thereof and thereby providing a channel-shaped passage 26 therebetween. The opposing surfaces of the upper and lower portions 20,22 are configured to provide recesses 28 respectively for comfortably seating the user's fingers 18. Moreover, the side surfaces of the lower portion 22 also have recesses 30 therein configured to comfortably seat the user's fingers 18 as they encircle the lower portion 22 of the grip 12.

Figure 4:
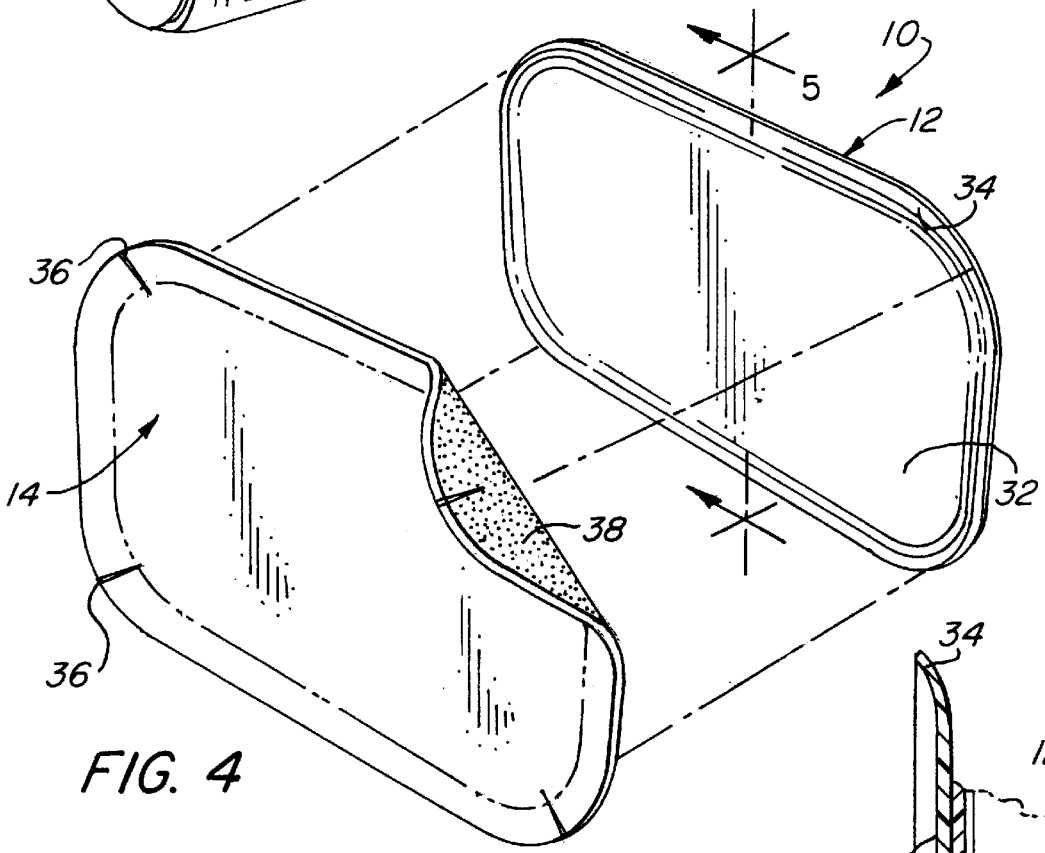
FIG. 4 is a front perspective view of the carrier with the cleaning pad removed from the carrier and with a corner of the pad bent over.

Turning next in detail to the carrier 10 and pad 14 as best seen in FIG. 4, the carrier has a shallow recess 32 formed in its upper or outer surface with a peripheral ridge 34 extending thereabout. Seated on the upper surface is the cleaning pad 14 which has slits 36 at the comers thereof to facilitate forming the pad 14 about the peripheral edge of the carrier 10, and the cleaning pad 14 is secured to the surface of the carrier 10 by adhesive 38.

As will be appreciated, the carrier 10 is generally rectangular in configuration and is relative thin so that it can be moved into narrow spaces such as that between the windshield 56 and the dashboard 58. It is conveniently formed from synthetic resin either by thermoforming sheet stock or by injection molding. The grip 12 is conveniently injection molded from synthetic resin and is bonded to the surface of the carrier member 10 by adhesive (not shown) or sonic welding. The grip 12 is disposed with its elongated axis extending in the same direction as the elongated axis of the carrier 10 but offset from the longitudinal centerline so as to permit the most facile usage of the cleaner in narrow spaces such as the juncture between the windshield 56 and dashboard 58 as seen in FIG. 2.

Figure 6:
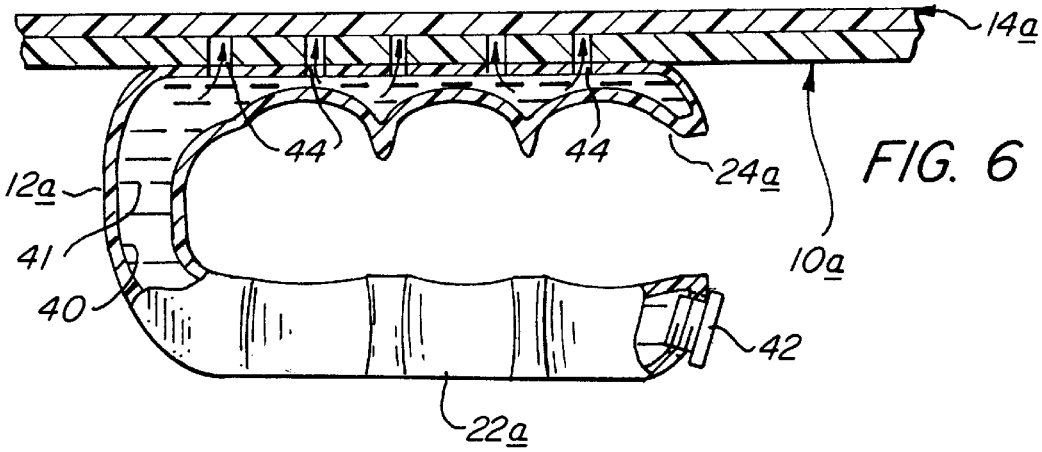
FIG. 6 is an elevational view of an embodiment of cleaner having a reservoir for cleaning liquid.

Turning next to FIG. 6, therein illustrated is a desirable embodiment of the present invention wherein the grip 12*a* is molded with a hollow cavity 40 providing a reservoir for cleaning fluid 41 which can be introduced into the cavity through the fill plug 42. The upper portion 24*a* of the grip 12*a* and the carrier 10*a* are porous or have small passages 44 therein through which fluid 41 from the reservoir 40 passes to saturate the cleaning pad 14*a*. By molding the grip from flexible material, the user can squeeze the lower portion 22*a* to pressurize the fluid in the reservoir 40 and cause it to flow more freely through the apertures 44 into the cleaning pad 14*a*.

Figure 7:
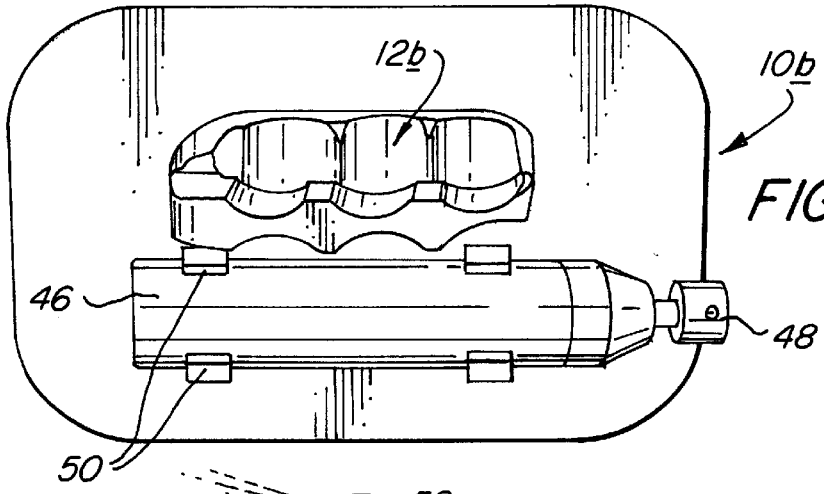
FIG. 7 is a rear view of another embodiment of cleaner having a spray canister mounted thereon.

Turning next to FIG. 7, therein illustrated is still another embodiment of the hand-supported wiper in which the carrier 10*b* is molded with clips 50 on its rear surface at a point spaced from the grip 12*b* to permit the fingers to fit comfortably therebetween. Seated in the clips 50 is a spray bottle 46 of cleaning fluid and the fluid may be dispensed by actuation of the plunger head 48.

Figure 8:
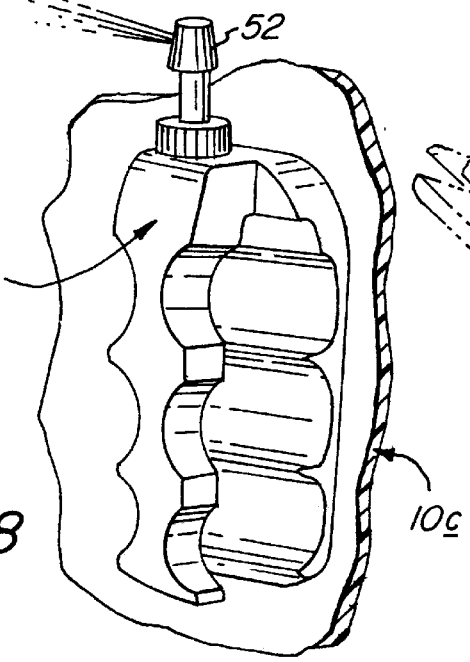
FIG. 8 is a fragmentary perspective view of a modification of the embodiment of FIG. 6 which includes a sprayer head for dispensing the fluid from the reservoir rather than using a porous carrier.

FIG. 8 illustrates a variation of the embodiment of FIG. 6 in which the plug 42 is replaced by a spray head 52 which can be actuated to dispense fluid onto the surface of the windshield. In this embodiment, it is not necessary that the grip 12*c* be molded from flexible material and that there be passages in the upper portion 20 of the grip and carrier member 10 to allow fluid to pass through.

Figure 9:
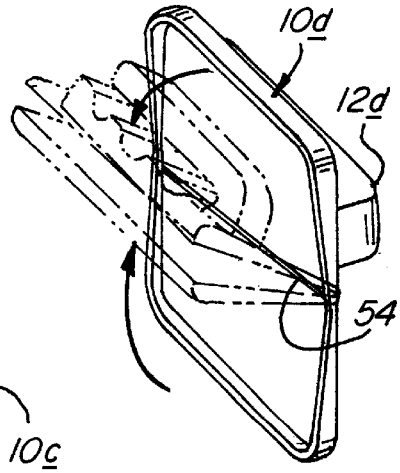
FIG. 9 is a fragmentary perspective view of another embodiment of carrier which includes an integral hinge in the plate portion to permit folding to reduce the volume of storage space required.

Turning lastly to FIG. 9, therein illustrated is another desirable embodiment of the present invention in which the carrier 10*d* is formed from a material such as polypropylene with an integral hinge or fold line 54 about which the carrier 10*d* may be folded to reduce the volume which is occupied by the carrier in the glove compartment or other storage area. The grip 12*d* may be molded from the same material.

In analyzing the use of the hand to support and move a cleaning pad, it was discovered that the anatomy of the human hand is such that the knuckles and adjacent portion of the fingers when the hand is in the configuration of a fist make an angle which often parallels the angle of the automobile windshield relative to the dashboard Not only is the angle of the fist generated easily and aligned to the angle of the inside of the windshield but also a substantial amount of force can be generated by the fist in this configuration. The force generated can be applied to push the cleaning pad against the windshield with a substantial amount of force to provide a high level of resultant cleaning action.

As can be seen from the attached drawings, the grip makes use of the natural angular alignment of the knuckles and adjacent portion of the fingers. The area of the upper portion of the grip is the bearing area for the knuckles and adjacent portion of the fingers when the wiper is in place in the human hand. The lower portion of the grip is elongated in the horizontal plane to allow for a firm placement in the palm and the comfortable wrap of the fingers thereabout when the human hand grasps the cleaner. The grip is open on one end so that it can be easily worn on either hand with a minimum amount of manipulation.

The carrier is symmetrical with regards to its up and down orientation, so that the grip can be grasped with the closed area to the right or to the left regardless of the hand upon which it is placed. Since the grip is asymmetric with regards to its attachment to the carrier, there is an overall top and bottom to the complete cleaner.

Figure 5:
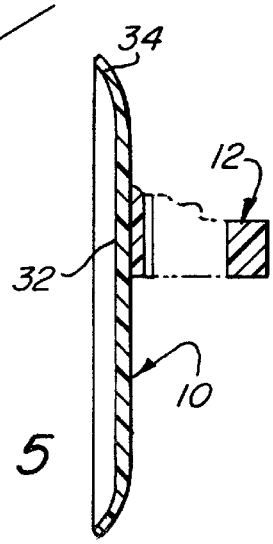
FIG. 5 is a sectional view of the carrier along the line 5—5 of FIG. 4.

As seen in FIG. 1, the grip is firmly positioned in the palm and held securely with a minimum of sideways translation as the device is pressed against the surface to be cleaned. As seen in FIGS. 4 and 5, the carrier is concave in both its longitudinal and transverse axes. When pressed firmly against the surface to be cleaned, the carrier will flex somewhat and assume the contour of the surface. Because of the bi-concave nature of the carrier, there will be a substantial bearing force exerted against the windshield even in the peripheral area of the carrier.

The synthetic resin used for the carrier should exhibit a reasonable degree of intrinsic rigidity. A smooth surface is desirable to allow the cleaning pad to adhere to the carrier. A small degree of flexibility is desired both to provide a pleasing "feel" for the grip in the human hand and to protect areas adjacent to the windshield from being scratched or scuffed as the wiper is used. The carrier and the grip can be molded from different synthetic resins.

As seen in FIG. 5, the grip is located approximately ⅓ from the top edge of the carrier. This design yields several unique advantages. By attaching the grip adjacent the top of the carrier, it is easier to clean the lower portion of the windshield near the dashboard. Since many modern dashboards are curved, there can be an area of the lower windshield that has limited access. By positioning the grip as shown, the carrier can be easily extended in tight access areas.

The corners of the rectangular carrier should be arcuate so that the carrier can move readily into the corners of the automobile windshield.

If the carrier is rotated 180 degrees, tight or restricted areas at the top of the windshield can be similarly accessed and the proper orientation for cleaning will still be maintained. The cleaner can easily be worn on the right or left hand with the carrier extended upwardly or downwardly depending on whether the open portion of the grip is positioned toward the right or the left.

The back of the cleaning pad has a coating of adhesive which is used to removably secure it to the carrier, and the adhesive is covered by release paper or film. The cleaning pad is conveniently provided as a part of a roll. When it is time to place a new cleaning pad on the carrier, a cleaning pad is severed from the large roll and the release paper pad is peeled therefrom. The cleaning pad is slightly larger than the plate with die cuts at the corners so that the peripheral portions can be rolled around the edges of the carrier to insure that all the edges of the carrier are covered by the pad, and remain covered when side to side force is exerted during the cleaning process.

Thus, it can be readily seen from the foregoing detailed description and attached drawings that the hand-supported windshield cleaner of the present invention may be fabricated readily and is easily used to clean the peripheral areas of the windshield including the area adjacent the juncture of the windshield and dashboard. The absorbent cleaning pads can be readily replaced, and cleaning fluid can be included as a part of the cleaner assembly.

Having thus described the invention, what is claimed is:

1. A hand-supported wiper for cleaning automobile windshields comprising:

(a) a carrier member of generally planar configuration with a peripheral edge extending thereabout, said edge having at least one substantially rectilinear portion providing two corners;

(b) a stationary grip on one surface of said carrier member disposed entirely inwardly of said peripheral edge, said grip being configured to enable facile gripping by a user, the other surface of said carrier member being substantially planar;

(c) a substantially planar, unitary, disposable cleaning pad releasably engaged on said substantially planar other surface of said carrier member and extending over the peripheral edge of said carrier member, said grip being spaced inwardly from said rectilinear portion of said peripheral edge of said carrier member a distance dimensioned to enable a user to move said rectilinear portion of said peripheral edge of said carrier member and said cleaning pad extending thereover into the area of the windshield adjacent the juncture with the dashboard of a vehicle while the user's fingers are firmly engaged with said grip.

2. A hand-supported wiper for cleaning automobile windshields comprising:

(a) a carrier member of generally planar configuration with a peripheral edge extending thereabout, said edge having a rectilinear portion providing at least two corners;

(b) a stationary grip on one surface of said carrier member and disposed entirely inwardly of said peripheral edge, said grip being configured to enable facile gripping by a user; and (c) a disposable cleaning pad on the other surface of said carrier member and extending over the peripheral edge of said carrier member, said other surface of said carrier member providing a shallow recess in which a major portion of said cleaning pad is disposed with marginal portions of said pad extending at least to said peripheral edge of said carrier member, said grip being spaced inwardly from said rectilinear portion of said peripheral edge of said carrier member a distance dimensioned to permit said peripheral edge of said carrier and said cleaning pad extending thereover to be moved into the area of the windshield adjacent the juncture with the dashboard of a vehicle while the user's fingers are firmly engaged with said grip.

3. The hand-supported wiper in accordance with claim 2 wherein the portion of said recess adjacent the periphery thereof slopes gradually outwardly and upwardly to said edge of said carrier member.

4. The hand-supported wiper in accordance with claim 1 wherein said carrier member is of generally polygonal configuration with multiple corners and said pad is of complementary configuration.

5. A hand-supported wiper for cleaning automobile windshields comprising:

(a) a carrier member of generally planar configuration with a peripheral edge extending thereabout, said carrier member being of generally polygonal configuration with multiple comers;

(b) a stationary grip on one surface of said carrier member and disposed entirely inwardly of said peripheral edge, said grip being configured to enable facile gripping by a user;

(c) a disposable cleaning pad on the other surface of said carrier member and extending over the peripheral edge of said carrier member, said pad having slits extending inwardly adjacent corners thereof to facilitate forming of said pad over said peripheral edge of said carrier member, said grip being spaced inwardly from rectilinear portion of said peripheral edge of said carrier member a distance dimensioned to permit said peripheral edge of said carrier and said cleaning pad extending thereover to be moved into the area of the windshield adjacent the juncture with the dashboard of a vehicle while the user's fingers are firmly engaged with said grip.

6. The hand-supported wiper in accordance with claim 1 wherein said pad is fabricated of an absorbent fibrous material.

7. The hand-supported wiper in accordance with claim 1 wherein said pad has an adhesive on one surface releasably adhering said pad to said carrier member.

8. The hand-supported wiper in accordance with claim 1 wherein said grip extends in a plane which is generally perpendicular to the plane of said carrier member.

9. The hand-supported wiper in accordance with claim 1 wherein said grip has a passage in which the fingers of a user may extend.

10. The hand-supported wiper in accordance with claim 9 wherein said passage extends generally parallel to said carrier member and has generally horizontally oriented walls bounding said passage.

11. The hand-supported wiper in accordance with claim 10 wherein at least one of said horizontally oriented walls defining opposed sides of said passage has arcuate recesses in which the user's fingers seat.

12. The hand-supported wiper in accordance with claim 11 wherein the outer surface of said grip has arcuate recesses in which fingers of a user may seat.

13. The hand-supported wiper in accordance with claim 1 wherein said carrier member is porous and said wiper includes a reservoir on said one surface of said carrier member for cleaning fluid in contact with said support member to transfer fluid therethrough to said cleaning pad.

14. The hand-supported wiper in accordance with claim 3 wherein said grip has a cavity therein providing said reservoir.

15. The hand-supported wiper in accordance with claim 1 wherein said carrier member has a mounting means on said one surface spaced from said grip and wherein said hand-held wiper includes a container for cleaning fluid disengageably seated in said mounting means.

16. The hand-supported wiper in accordance with claim 1 wherein said carrier member is of polygonal configuration providing multiple rectilinear portions and corners, said grip being spaced inwardly from the peripheral edge of said carrier member a distance dimensioned to enable at least one of rectilinear portions and corners of said peripheral edge of said carrier member and cleaning pad to extend into the juncture between the windshield and dashboard.

17. The hand-supported wiper in accordance with claim 1 wherein said carrier member is generally rectangular.

18. The hand-supported wiper in accordance with claim 1 wherein said carrier member is foldable in the direction of said other surface to facilitate storage.

19. The hand-supported wiper in accordance with claim 18 wherein said carrier member is fabricated from synthetic resin and includes an integral hinge to permit folding.

* * * * *

UNITED STATES PATENT AND TRADEMARK OFFICE

CERTIFICATE OF CORRECTION

PATENT NO. : 6,543,951 B1
DATED : April 8, 2003
INVENTOR(S) : Robert C. Bauman

It is certified that error appears in the above-identified patent and that said Letters Patent is hereby corrected as shown below:

Column 6,
Line 15, "comers" should read -- corners --.

Signed and Sealed this

Twenty-ninth Day of June, 2004

JON W. DUDAS
*Acting Director of the United States Patent and Trademark Office*